US011187052B2

(12) United States Patent
Angstmann et al.

(10) Patent No.: US 11,187,052 B2
(45) Date of Patent: Nov. 30, 2021

(54) EXPLOSIVE DISCONNECT

(71) Applicant: Kinetic Pressure Control Limited, Houston, TX (US)

(72) Inventors: Steven Angstmann, Houston, TX (US); Bobby Gallagher, Houston, TX (US); Billy Gallagher, Houston, TX (US)

(73) Assignee: Kinetic Pressure Control Ltd., Houston, TX (US)

( * ) Notice: Subject to any disclaimer, the term of this patent is extended or adjusted under 35 U.S.C. 154(b) by 0 days.

(21) Appl. No.: 17/064,185

(22) Filed: Oct. 6, 2020

(65) Prior Publication Data

US 2021/0032951 A1 Feb. 4, 2021

Related U.S. Application Data

(63) Continuation-in-part of application No. 16/434,215, filed on Jun. 7, 2019, now abandoned, which is a continuation of application No. PCT/US2017/057826, filed on Oct. 23, 2017.

(60) Provisional application No. 62/431,455, filed on Dec. 8, 2016.

(51) Int. Cl.
*E21B 33/038* (2006.01)
*E21B 33/064* (2006.01)

(52) U.S. Cl.
CPC ..... *E21B 33/038* (2013.01); *E21B 33/064* (2013.01)

(58) Field of Classification Search
CPC ..... E21B 33/038; E21B 33/064
See application file for complete search history.

(56) References Cited

U.S. PATENT DOCUMENTS 4,424,968 A * 1/1984 Smith ..... A63B 63/083 403/408.1
5,123,794 A * 6/1992 Pire ..... B64G 1/645 411/383
5,671,650 A * 9/1997 Aubret ..... B64G 1/641 102/378
6,095,736 A * 8/2000 Miller ..... F16B 41/002 411/107
6,119,984 A * 9/2000 Devine ..... B64G 1/222 244/172.9
6,227,300 B1 * 5/2001 Cunningham ..... E21B 33/035 166/339
6,406,074 B1 * 6/2002 Mahaney ..... E05B 65/0089 292/256.6
6,939,073 B1 * 9/2005 Ahmed ..... F16B 31/00 403/2
8,770,298 B2 * 7/2014 Gustafson ..... E21B 41/0021 166/359

(Continued)

*Primary Examiner* — Aaron L Lembo
(74) *Attorney, Agent, or Firm* — Victor H. Segura

(57) ABSTRACT

A coupling system includes a lower marine riser package having a connector at a bottom end and a blowout preventer having a connector at an upper end. Explosively frangible fasteners with explosively frangible nuts sealed off from the external environment are used to couple the connector on the lower marine riser package to the connector on the blowout preventer. A method for separating a lower marine riser package from a blowout preventer includes electronically triggering the detonation of a plurality of explosively frangible fasteners coupling the blowout preventer to the lower marine riser package.

20 Claims, 13 Drawing Sheets

(56) References Cited

U.S. PATENT DOCUMENTS 8,857,520 B2 * 10/2014 Hoffman ..... E21B 33/038 166/351
9,062,517 B2 * 6/2015 Edwards ..... E21B 33/064
9,222,327 B2 * 12/2015 Humphreys ..... E21B 7/12
9,488,024 B2 * 11/2016 Hoffman ..... E21B 33/035
9,810,515 B1 * 11/2017 Current ..... F42C 15/40
10,066,458 B2 * 9/2018 Deacon ..... E21B 34/02
10,577,885 B2 * 3/2020 Drobniak ..... E21B 34/16
2001/0001633 A1 * 5/2001 Fisher ..... E21B 17/012 405/224.2
2002/0164204 A1 * 11/2002 Kaszubowski ..... B64G 1/645 403/322.1
2004/0099420 A1 * 5/2004 Kotrla ..... E21B 33/076 166/345
2004/0156669 A1 * 8/2004 Lejeune ..... F01D 21/045 403/2
2011/0247827 A1 * 10/2011 Humphreys ..... E21B 17/085 166/345
2011/0303416 A1 * 12/2011 Herman, II ..... E21B 33/038 166/350
2012/0043089 A1 * 2/2012 Hoffman ..... E21B 33/076 166/340
2012/0318516 A1 * 12/2012 Beynet ..... E21B 43/0122 166/344
2013/0020086 A1 * 1/2013 Anderson ..... E21B 33/064 166/339
2013/0032351 A1 * 2/2013 Smith ..... E21B 33/038 166/339
2013/0192843 A1 * 8/2013 Abel ..... E21B 43/0122 166/341
2014/0190703 A1 * 7/2014 Tennant ..... E21B 17/07 166/365
2015/0308211 A1 * 10/2015 Fleming ..... E21B 33/06 166/363
2015/0345231 A1 * 12/2015 Thomas ..... E21B 17/06 166/377
2017/0268315 A1 * 9/2017 Reyes ..... E21B 37/02
2019/0338614 A1 * 11/2019 Angstmann ..... E21B 33/064

* cited by examiner

EXPLOSIVE DISCONNECT

CROSS REFERENCE TO RELATED APPLICATIONS

Continuation-in-Part of U.S. patent application Ser. No. 16/434,215 filed Jun. 7, 2019, which is a Continuation of International Application No. PCT/US2017/057826 filed Oct. 23, 2017, which claims priority from U.S. Provisional Application No. 62/431,455 filed on Dec. 8, 2016. All of the foregoing applications are incorporated herein by reference in their entirety.

BACKGROUND

This disclosure relates to the field of well pressure control apparatus. More particularly, the disclosure relates to methods and devices for quickly disconnecting a lower marine riser package (LMRP) or other device from a well pressure control device coupled to a subsea wellhead.

Marine wellbore drilling techniques known in the art include the use of a pressure control apparatus such as a blowout preventer ("BOP") disposed proximate the water bottom and coupled to the upper end of a surface conduit or casing disposed in the well (e.g., a "wellhead"). The BOP may comprise one or more sets of reversibly operable pressure control elements, for example, "blind rams", "shear rams" and an annular seal. Blind rams fully close an interior bore of the BOP housing to hydraulically isolate the well below the BOP housing. Shear rams may be provided to enable cutting through conduit and/or drilling tools disposed within the interior bore in the BOP housing and subsequently closing to hydraulically isolate the well below the shear rams. Annular seals may be used where it is desired to hydraulically isolate the well while enabling a conduit such as drill pipe or drilling tools to pass through the BOP housing.

Each of the foregoing ram-type pressure control elements may be disposed in opposed pairs on the BOP housing and may be operated by respective hydraulic rams. Hydraulic fluid pressure to operate the various rams and/or the annular seal may be controlled by an hydraulic fluid line extending from a control valve manifold to a drilling platform on the water surface, and by providing a plurality of accumulators each having hydraulic fluid and gas (e.g., nitrogen) under pressure to supply a relatively large volume of fluid rapidly in the event it becomes necessary to close any one or more of the pressure control elements in the BOP. The accumulators also can supply hydraulic fluid even in the event the hydraulic fluid line to the surface becomes blocked or disconnected. A plurality of the foregoing types of pressure control elements may be connected to each other along the respective interior bores to form a BOP "stack."

A BOP "stack" (i.e., two or more of the foregoing type of well pressure control devices arranged longitudinally one atop the other) may be coupled, at one longitudinal end opposed to the longitudinal end connected to the wellhead, to a conduit (e.g., a "riser") that extends to a drilling platform proximate the water surface. Coupling to the riser may be through a set of devices called a "lower marine riser package" (LMRP). In certain situations, for example, adverse weather conditions, that make it desirable to move the riser and the drilling platform away from the well location, it then becomes necessary to disconnect the riser from the BOP stack. Disconnection may be performed, for example, by uncoupling the LMRP from the BOP stack after closing one or more pressure control elements in the BOP stack. Uncoupling may include, for example and without limitation, unthreading threaded connectors, removing coupling bolts from mating flanges and/or releasing a profile connector (e.g., by rotating components of the LMRP, via application of hydraulic pressure).

Disconnecting the LMRP from the BOP stack in a station keeping emergency is a very important function for a BOP stack. It is known in the art to take one minute or longer to complete an emergency disconnect. Using known methods for LMRP disconnection such as by uncoupling the example devices described above may require that disconnection decisions are made early, e.g., dynamic positioning watch circles need to consider the disconnect time. In addition, permissible LMRP connector release angles can be smaller than flex joint angle ratings. That is, the LMRP release angle can be governing as to the amount of movement of the drilling platform during disconnect operations.

SUMMARY

A coupling system according to one aspect of the present disclosure includes a lower marine riser package configured with a connector and a blowout preventer configured with a connector. Explosively frangible fasteners comprising explosively frangible nuts are disposed to couple the lower marine riser package connector to the blowout preventer connector, wherein the explosively frangible nuts are sealed off from the external environment. Each explosively frangible nut has at least one explosive charge disposed thereon. At least one explosively frangible nut is configured for electronic triggering to set off the at least one explosive charge disposed on the nut.

In some embodiments the explosively frangible nuts are each configured with at least two explosive charges disposed thereon.

In some embodiments a pyrotechnic crossover is disposed on each explosively frangible nut to link the at least two explosive charges on the nut such that activation of one explosive charge sets off activation of each linked explosive charge.

In some embodiments the explosively frangible nuts are sealed off from the external environment via a housing configured on one of the lower marine riser package connector and the blowout preventer connector.

In some embodiments at least one environmental sensor is disposed within the housing.

In some embodiments the housing is configured to contain fragments from the explosively frangible nuts.

In some embodiments the housing is configured to house wiring used for the electronic triggering.

In some embodiments the explosively frangible nuts are pyrotechnically linked together such that activation of one explosive charge on one nut sets off activation of each linked explosive charge on the linked nuts.

In some embodiments the explosively frangible nuts are pyrotechnically linked together via interlinked pyrotechnic crossovers disposed on the explosively frangible nuts to link the explosive charges disposed thereon.

In some embodiments the lower marine riser package connector is coupled to the blowout preventer connector via a plurality of studs configured to engage the connectors, with each stud comprising one of the explosively frangible nuts disposed on an end thereof.

In some embodiments one of the lower marine riser package connector and the blowout preventer connector is configured with a bolt flange to receive the studs engaging the connector, wherein the bolt flange is configured with at least one enlarged stud receptacle to facilitate passage of the stud therethrough.

In some embodiments the plurality of studs configured to engage the lower marine riser package connector and the blowout preventer connector are configured in a circular pattern surrounding a fluid pass through in the engaged connectors.

In some embodiments the at least one explosively frangible nut configured for electronic triggering to set off the at least one explosive charge disposed on the nut comprises an initiator to trigger the at least one explosive.

In some embodiments a plurality of the explosively frangible nuts are each configured for electronic triggering to set off the at least one explosive charge disposed on the nut.

A method for separating a lower marine riser package from a blowout preventer includes electronically triggering the detonation of a plurality of explosively frangible fasteners comprising explosively frangible nuts coupling a connector on the blowout preventer to a connector on the lower marine riser package, wherein the explosively frangible nuts are sealed off from the external environment and each nut has at least one explosive charge disposed thereon. The lower marine riser package is then lifted from the blowout preventer.

In some embodiments electronically triggering the detonation of the plurality of explosively frangible fasteners comprises igniting at least one pyrotechnic crossover disposed on one of the explosively frangible nuts.

In some embodiments prior to electronically triggering the detonation of the plurality of explosively frangible fasteners the lower marine riser package connector is coupled to the blowout preventer connector via a plurality of studs configured to engage the connectors, with each stud comprising one of the explosively frangible nuts disposed on an end thereof.

In some embodiments one of the lower marine riser package connector and the blowout preventer connector is configured with a bolt flange to receive the studs engaging the connector, wherein the bolt flange is configured with at least one enlarged stud receptacle to facilitate passage of the stud therethrough.

In some embodiments electronically triggering the detonation of the plurality of explosively frangible fasteners comprises triggering an initiator coupled to one of the at least one explosive charges disposed on one of the explosively frangible nuts.

In some embodiments the explosively frangible nuts are sealed off from the external environment via a housing configured on one of the lower marine riser package connector and the blowout preventer connector.

DETAILED DESCRIPTION

Figure 1:
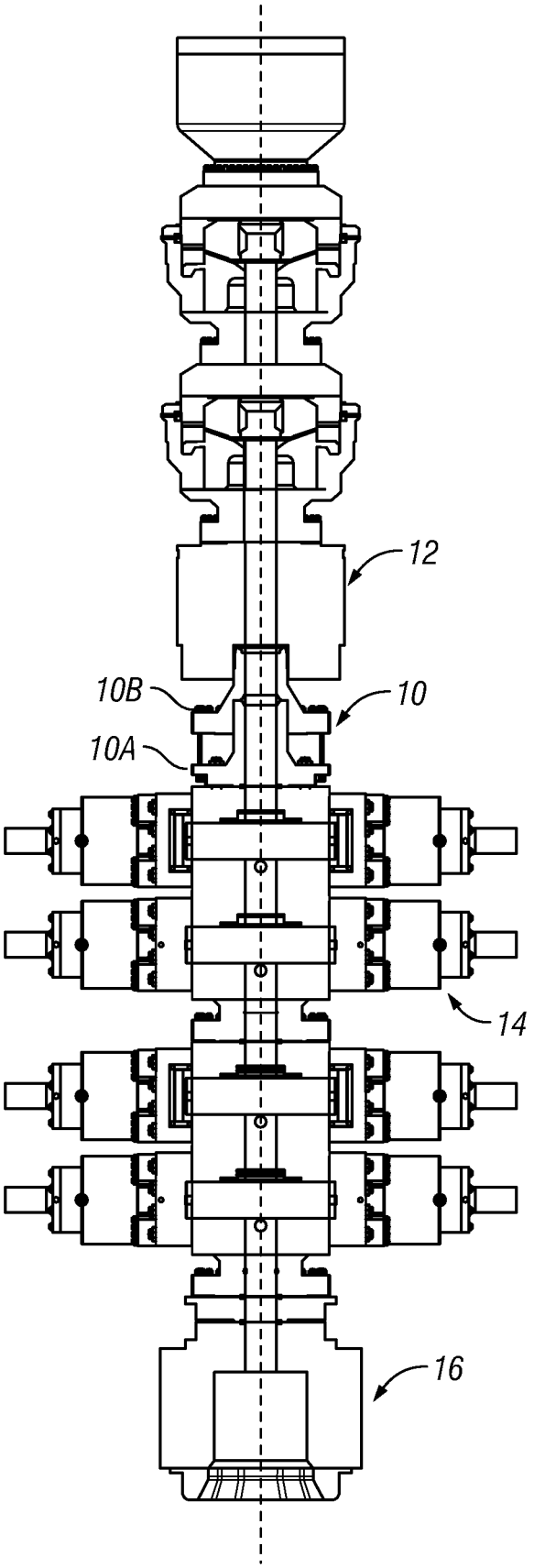
FIG. 1 shows an example embodiment of a LMRP connected to a subsea BOP stack, wherein the subsea BOP stack is connected to a subsea wellhead.

FIG. 1 shows an example embodiment of a lower marine riser package (LMRP) 12 connected to a subsea BOP "stack" 14 (i.e., a plurality of vertically assembled wellbore pressure control elements assembled to each other to produce a series connected set of well shut in valves), wherein the subsea BOP stack 14 is connected to a subsea wellhead (not shown) using a connector 16. A connector such as a double mandrel 10 may be used to connect the LMRP 12 to the BOP stack 14. The LMRP 12 may itself comprise one or more pressure control elements, or in some embodiments the LMRP 12 may not have any such pressure control elements.

The double mandrel 10 may comprise a lower mandrel 10A coupled to an upper end of the BOP stack 14 and an upper mandrel 10B coupled to a lower end of the LMRP 12. The lower mandrel 10A may be connected to the BOP stack 14, e.g., by a profile coupling, bolted flange, or any other connection known in the art. The upper mandrel 10B may be connected to the LMRP 12, for example, in any similar manner as the connection between the lower mandrel 10A and the BOP stack 14. A riser (not shown) may extend from the top of the LMRP 12 to a drilling platform (not shown) on the water surface. Although the BOP stack 14 shown in the various drawing figures and described herein may include a plurality of wellbore pressure control elements, for purposes of the present disclosure only one such pressure control element is needed.

Figure 2:
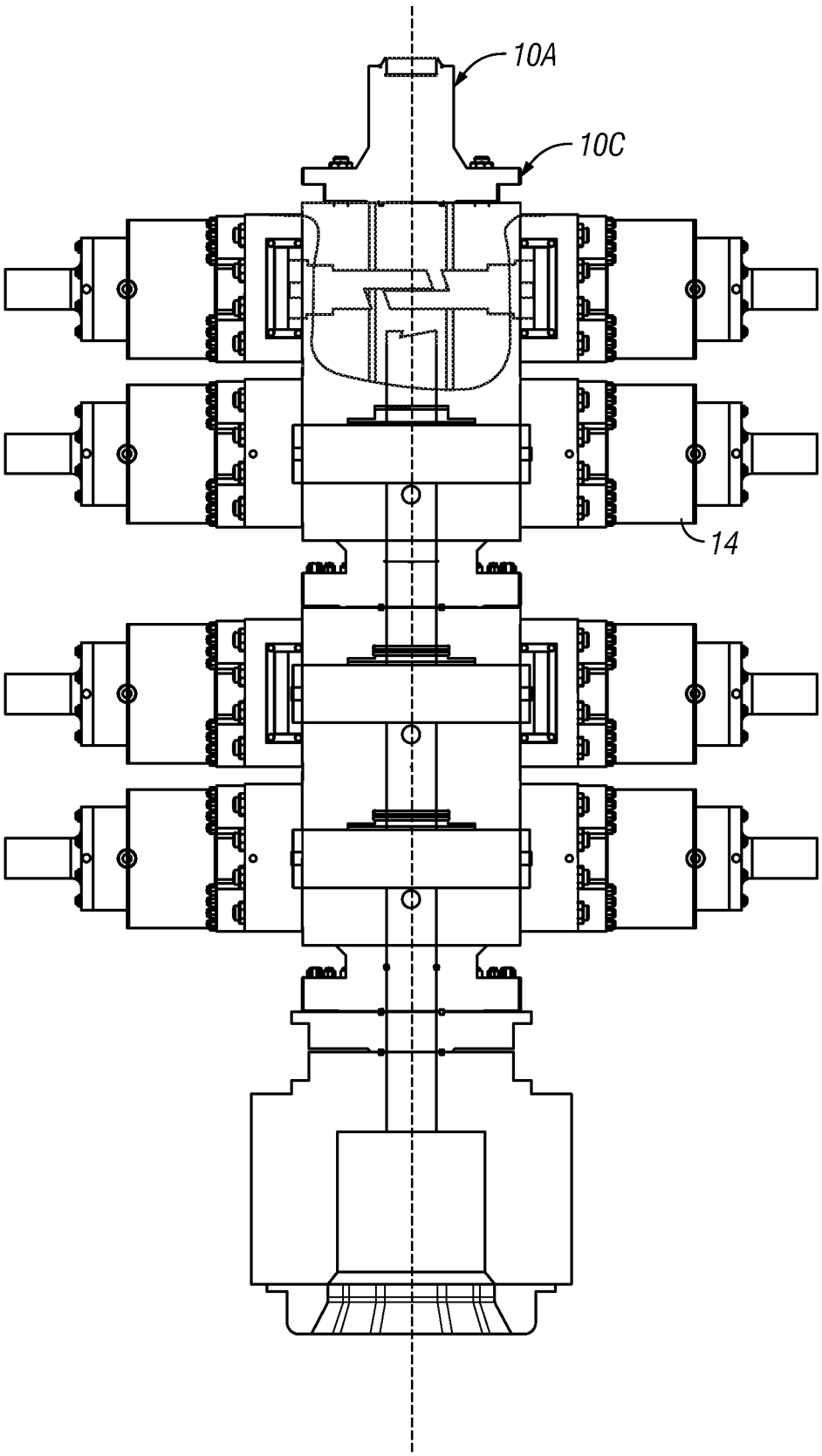
FIG. 2 shows the example embodiment of FIG. 1 wherein the LMRP has been disconnected from the subsea BOP stack. The LMRP is shown canted at a relatively large angle with reference to the subsea BOP stack.
Figure 2:
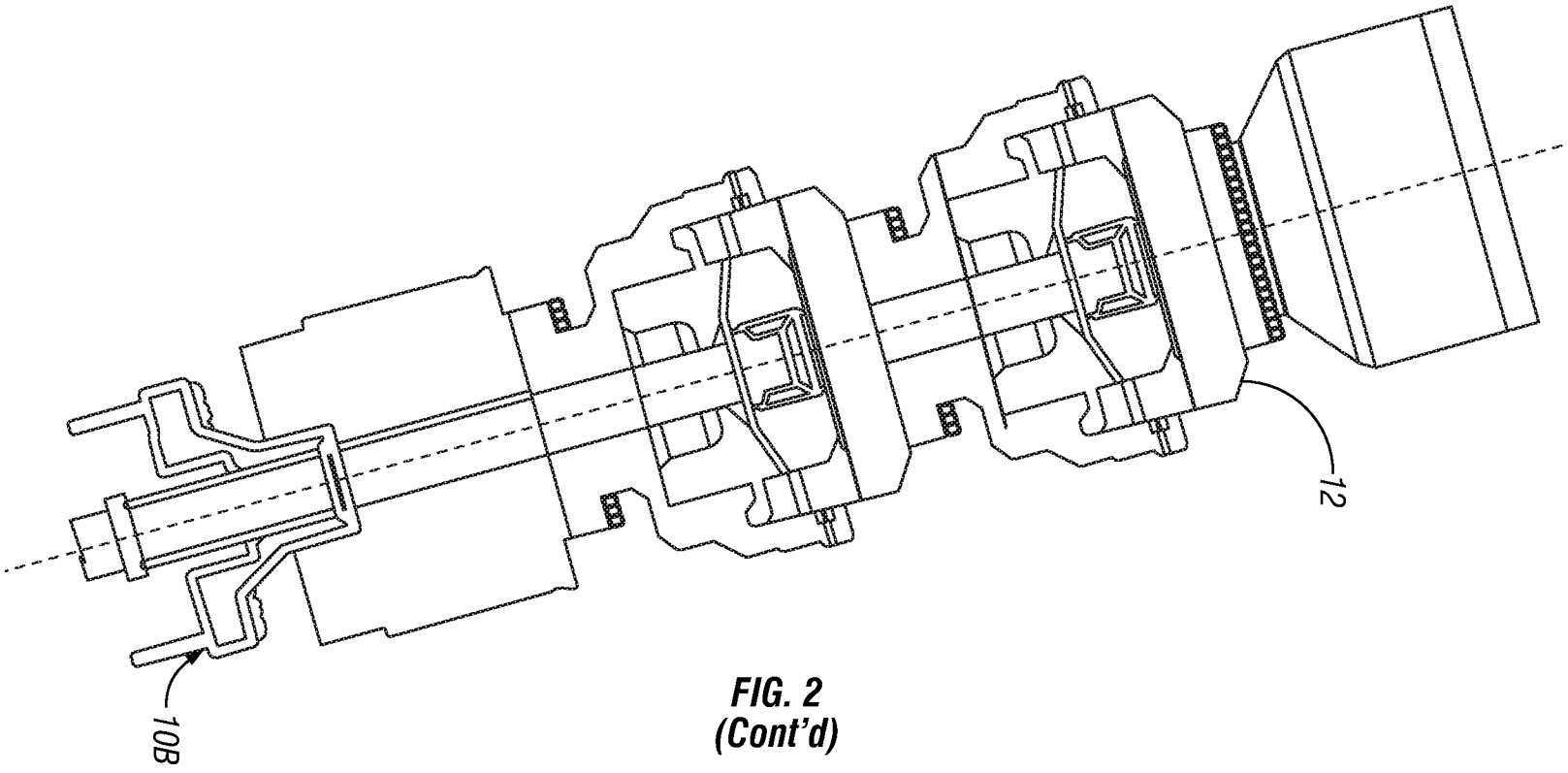

FIG. 2 shows the LMRP 12 disconnected from the BOP stack 14 by uncoupling the lower mandrel 10A from the upper mandrel 10B. The lower mandrel 10A and upper mandrel 10B may be configured such that a much greater angle between the longitudinal axis of the LMRP 12 and the BOP stack 14 may be obtained than by disconnect devices and methods known in the art.

Figure 3:
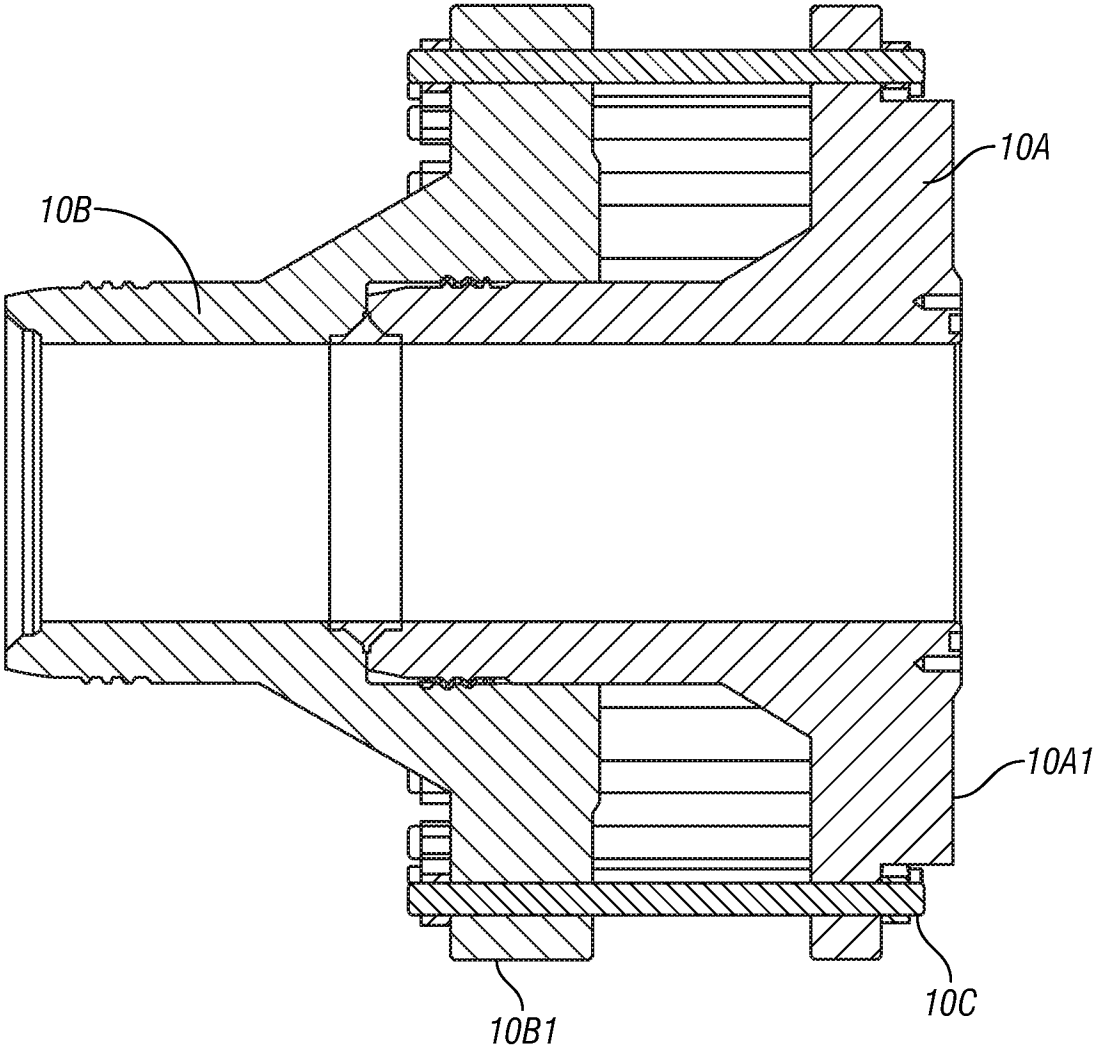
FIG. 3 shows a cross-section of an example embodiment of an explosive quick disconnect mandrel system according to the present disclosure.
Figure 4:
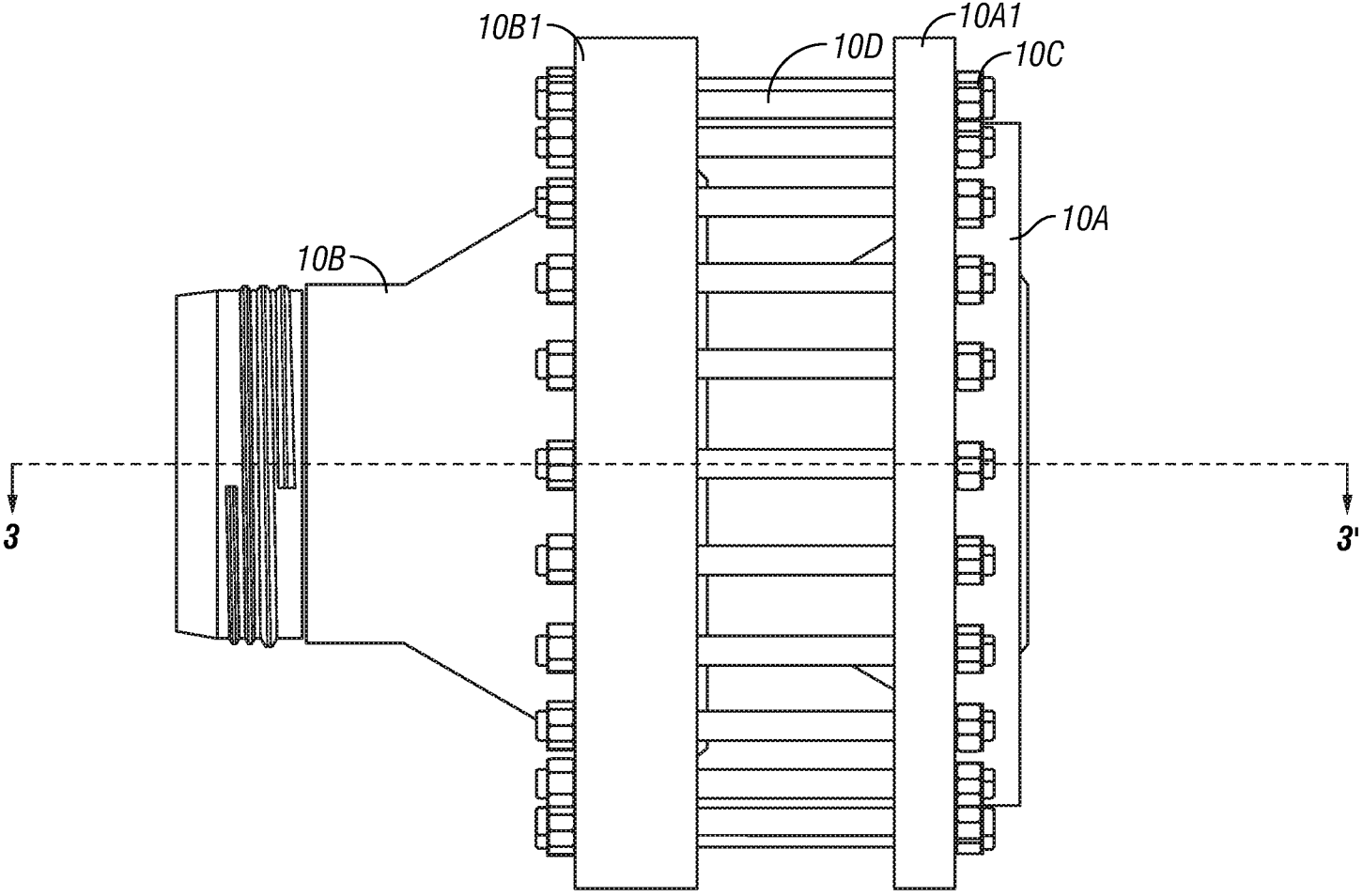
FIG. 4 shows a perspective side view of the example embodiment shown in FIG. 3.

In the present example embodiment, and referring to FIG. 3, such uncoupling may comprise detonating explosive frangible fasteners, for example explosively frangible nuts 10C and/or explosively frangible studs 10D (FIG. 4) which may couple a flange 10B1 on the upper mandrel 10B to a corresponding flange 10A1 on the lower mandrel 10A. Such explosively frangible nuts and/or explosively frangible studs may be obtained, for example, from Pacific Scientific Energetic Materials Company, 7073 West Willis Road, Chandler, Ariz. 85226. Example products sold by the foregoing organization comprise frangible nuts which are broken apart by detonation of an explosive charge and explosive bolts which are similarly broken apart. In the present example embodiment, such frangible nuts 10C may be used on one or both ends of studs 10D that pass through openings in the upper mandrel flange 10B1 and lower mandrel flange 10A1. FIG. 4 shows a perspective side view of the coupled upper mandrel 10B and lower mandrel 10A, wherein explosive nuts 10C are used on one end of the studs 10D.

Figure 5:
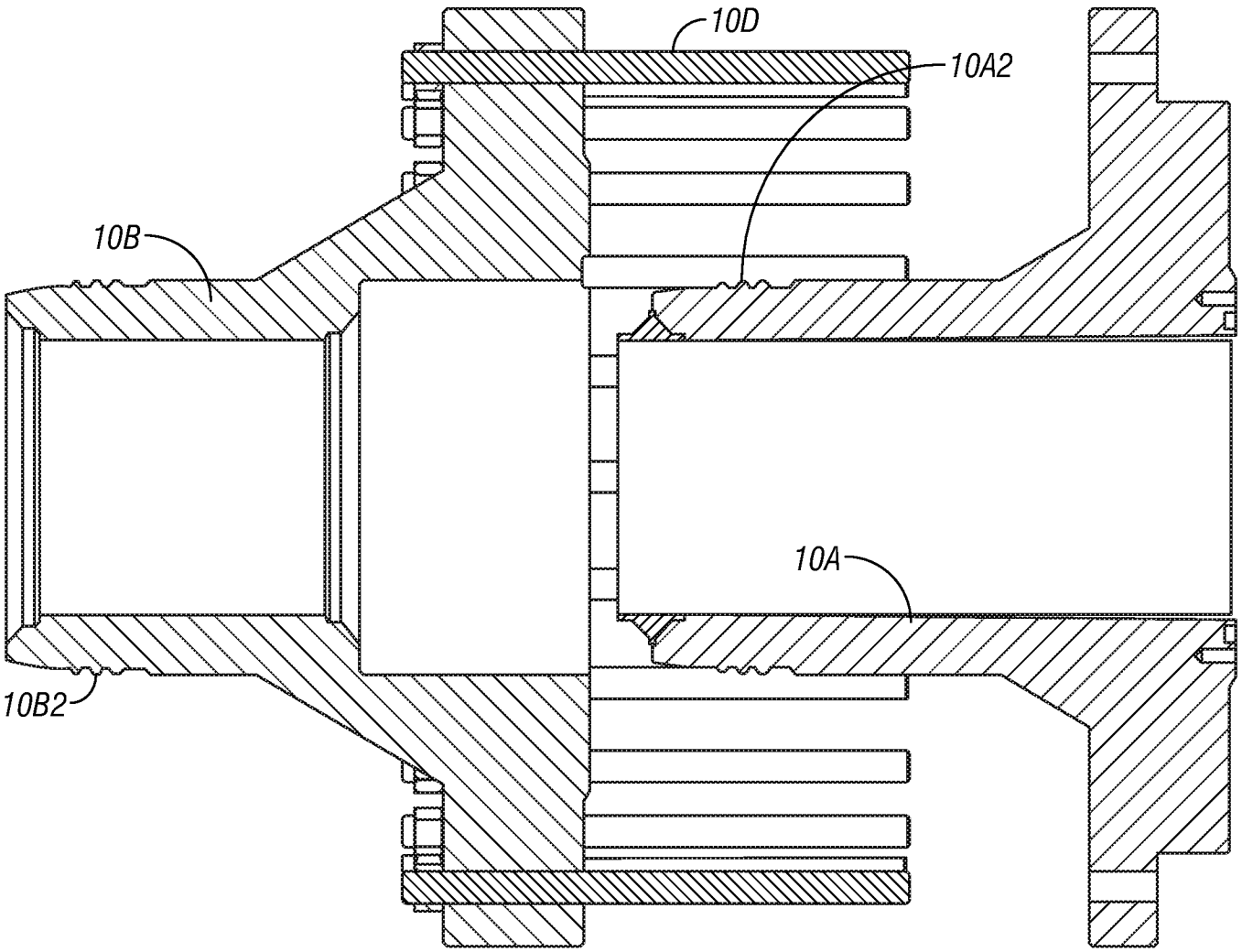
FIG. 5 shows a cross-section of the example explosive quick disconnect system of FIG. 3 after explosive removal of fasteners (e.g., studs and threaded nuts) that join an upper mandrel to a lower mandrel.
Figure 6:
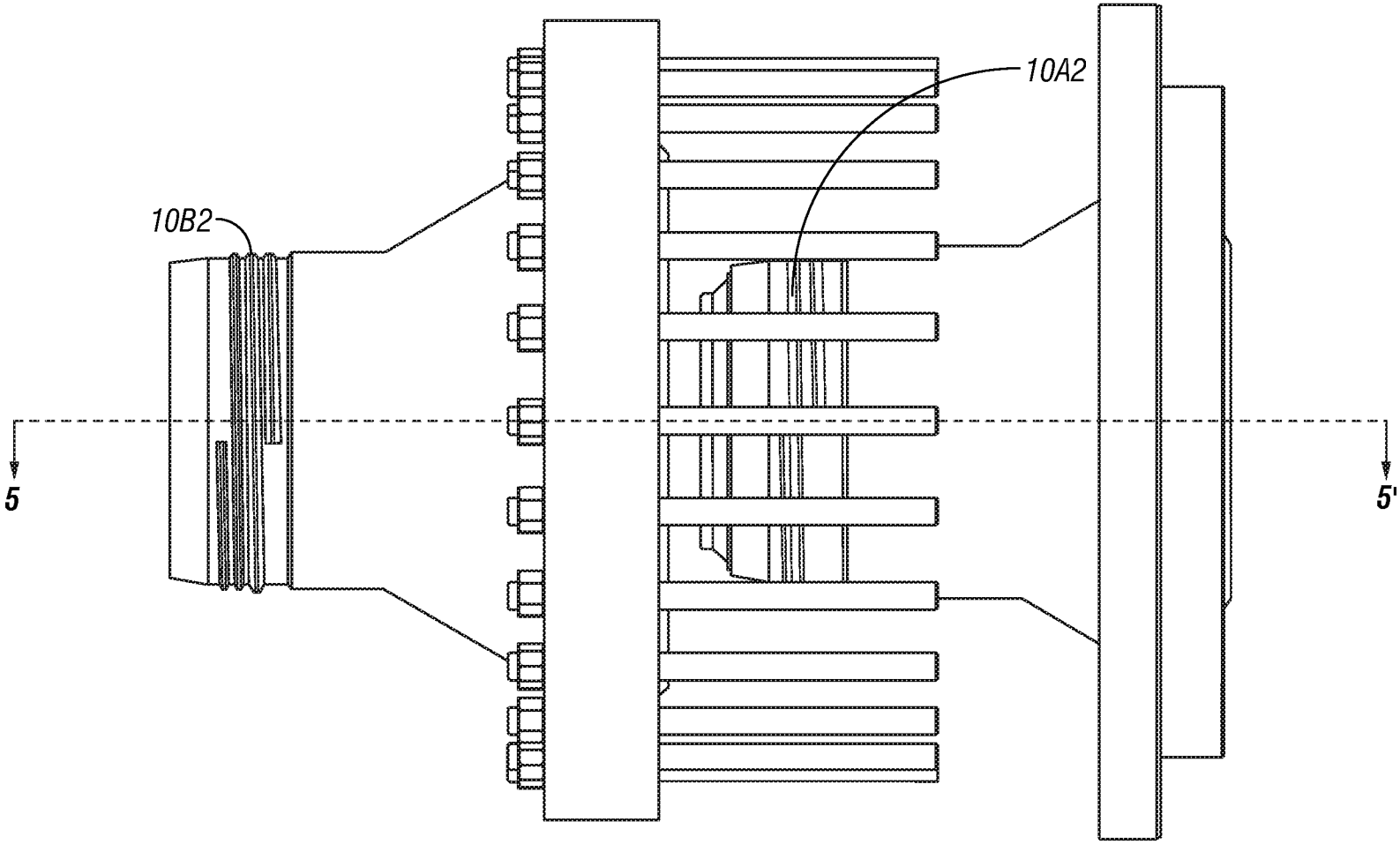
FIG. 6 shows a perspective side view of the illustration of FIG. 5.

FIGS. 5 and 6 show, respectively, a cross-section view and a perspective side view of the upper mandrel 10B being separated from the lower mandrel 10A after detonation of the explosively frangible fasteners (e.g., nuts 10C in FIGS. 3 and 4). The upper mandrel 10B may be separated from the lower mandrel 10A simply by lifting the LMRP (12 in FIG. 2) from the BOP stack (14 in FIG. 2). Profile connections 10B2 and 10A2 may be provided on one longitudinal end of each of the upper mandrel 10B and lower mandrel 10A respectively whereby the upper mandrel 10B may be coupled to the LMRP (12 in FIG. 2) using the profile connection 10B2. When the upper mandrel 10B is separated from the lower mandrel 10A, the profile connection 10A2 on the lower mandrel 10A may provide a mechanism to enable attaching devices to the lower mandrel 10A, e.g., to reconnect either the LMRP (12 in FIG. 2) or a capping stack to the BOP stack (14 in FIG. 2).

A system according to the present disclosure may comprise a BOP stack which is connected to the wellhead by a connector. A first mandrel with explosively frangible fasteners is located on top of the BOP stack. A lower marine riser package (LMRP) is connected to the mandrel by means of a connector. In some embodiments, the connector may be a second mandrel having a bolt flange corresponding to a bolt flange on the first mandrel. In some embodiments, the second mandrel may have a profile connector at one end for coupling to the LMRP. In some embodiments, the first mandrel may comprise a profile connector similar in configuration to the profile connector on the second mandrel, whereby after separation of the two mandrels, a connection may be provided on the first mandrel to reconnect the LMRP or to connect a capping stack or other device to the BOP stack.

Auxiliary connections between the LMRP and the BOP stack may comprise choke and kill lines, boost lines, hydraulic and/or electric power lines and sensors.

In some embodiments, a double mandrel arrangement with explosive nuts may be used between the BOP stack and the LMRP. This would allow the first mandrel to be released from the lower stack but would still maintain an intact mandrel connection to reconnect either the LMRP or capping stack to the lower stack.

In some embodiments the explosively frangible fasteners could be attached to any other flanged connection on the BOP stack or LMRP. In some embodiments, explosively frangible studs, bolts, or another type of explosively frangible fastener could be used instead of explosively frangible nuts.

A method for separating a LMRP from a BOP stack according to some embodiments may comprise closing a pressure control element, e.g., a shearing element (either a static force operated shear ram or a kinetic energy operated shear ram) in a BOP stack coupled at its upper end to a lower marine riser package (LMRP). All auxiliary connections between the BOP stack and LMRP (if any are present) are disconnected. Explosively frangible fasteners that couple the LMRP to the BOP stack are detonated to separate the LMRP from the BOP stack. In some embodiments, reconnection of the LMRP to the BOP stack or coupling of another device such as a capping stack may be performed by latching dogs onto a connecting profile at one end of the mandrel or connector on an upper longitudinal end of a mandrel on the BOP stack.

Figure 7:
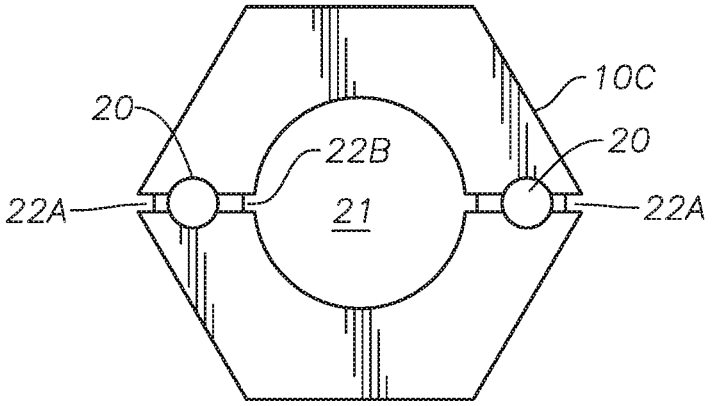
FIG. 7 shows a plan view of an example embodiment of an explosively frangible nut according to the present disclosure.
Figure 9:
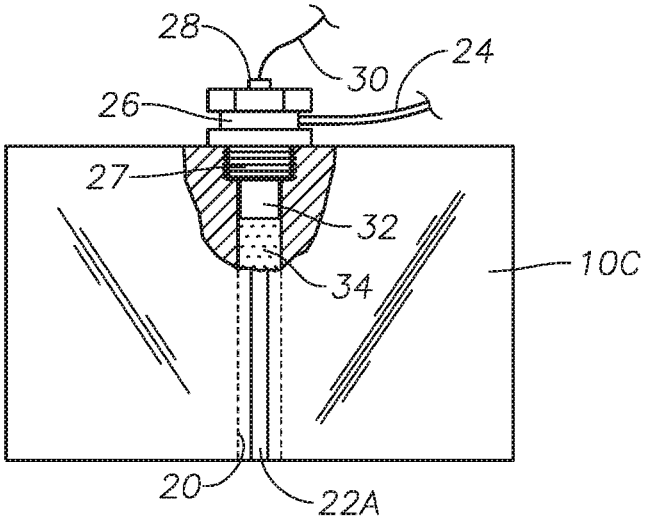
FIG. 9 shows a cross-section side view of an example embodiment of an explosively frangible nut according to the present disclosure.

FIG. 7 shows an example embodiment of an explosive frangible fastener, an explosively frangible nut 10C. As seen from an overhead view, the nut 10C has a central opening 21 with inner threads to receive and engage a threaded bolt, such as stud 10D. It will be appreciated by those skilled in the art that although a hexagonal shaped nut 10C is shown in the illustrations herein, embodiments of the nut 10C may be implemented in any configuration or shape available in commerce. In addition to the central threaded opening 21, the nut 10C is configured with one or more voids 20. In some embodiments, the void(s) 20 is cylindrical in shape and runs through the nut 10C body, from top to bottom (FIG. 9). Voids 20 are preferably located near vertices of the nut 10C. Some embodiments are also configured with a void or gap 22A extending from top to bottom along the outer edge of the vertex nearest the void 20. Another void or gap 22B may also be formed running from top to bottom of the nut 10C on the opposite side of the void 20, extending into the central opening 21. Nut 10C embodiments may be formed of any material as known in the art and suitable to allow for the nut to "split" apart upon detonation of an explosive charge as described herein. Conventional frangible nuts are provided by suppliers such as Ensign-Bickford Aerospace and Defense Company (https://www.ebad.com).

Figure 8:
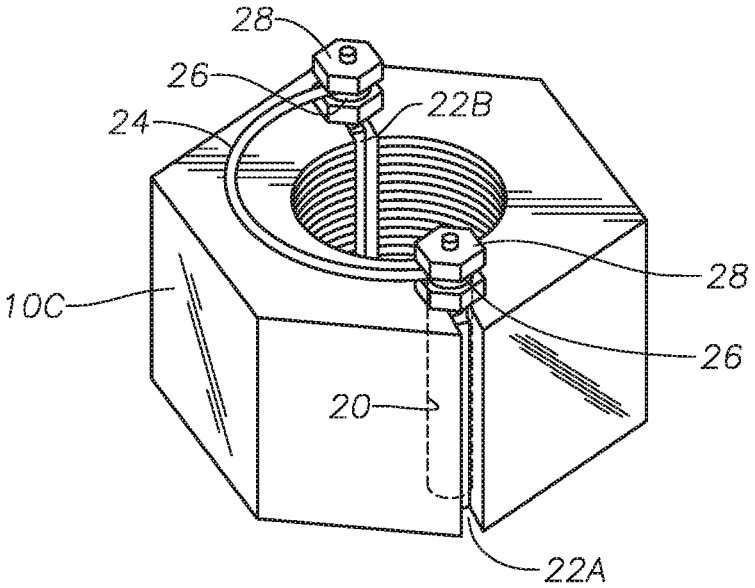
FIG. 8 shows a perspective view of an example embodiment of an explosively frangible nut according to the present disclosure.

FIG. 8 shows another example embodiment of an explosive frangible nut 10C. A pyrotechnic crossover 24 is disposed on the nut 10C. As known by those skilled in the art, a pyrotechnic crossover 24 (also conventionally known as detonating cord) is essentially a high-speed explosive fuse. The crossover 24 is a thin, flexible tube (e.g., plastic tube or bendable metal sheath) filled with an explosive material such as pentaerythritol tetranitrate (PETN). In this embodiment, the crossover 24 includes a connector 26 at each end. The velocity of detonation of the crossover 24 is sufficient to use it for synchronizing multiple charges to detonate almost simultaneously even if the charges are placed at different distances from the point of initiation. As such, any common length of the crossover 24 appears to explode instantaneously. In the embodiment shown in FIG. 8, one connector 26 of the pyrotechnic crossover 24 is coupled to an initiator 28 disposed within one of the voids 20 in the nut 10C. The connector 26 on the other end of the crossover 24 is coupled to a detonator 32 disposed in the other void 20 in the nut 10C (further described with respect to FIG. 9).

FIG. 9 shows a side view of the nut 10C of FIG. 8. In this embodiment, the pyrotechnic crossover 24 connector 26 is coupled to an initiator 28 that is securely engaged with threads 27 formed in the void 20. A suitable conventional initiator 28 may be used to implement the disclosed embodiments (e.g., as provided by PACSI EMC in Chandler, Ariz. https://psemc.com). The initiator 28 is electronically triggered to detonate when a current is applied via a lead 30 linking the initiator to a voltage source (not shown). The crossover 24 connector 26 is directly coupled with the initiator 28 such that when the initiator is activated the crossover instantaneously conveys the explosive detonation to the connector 26 at the other end of the crossover.

As shown in FIG. 9, the nut 10C includes a detonator 32 cartridge and an explosive charge 34 disposed within the void 20. A suitable conventional detonator 32 may be used to implement the disclosed embodiments (e.g., as provided by PACSI EMC in Chandler, Ariz. https://psemc.com). Upon activation of the initiator 28 by a current applied via the lead 30, the detonator 32 is ignited, which in turn sets off the explosive charge 34 (e.g. stabilized RDX cartridge). Detonation of the explosive charge 34 within the void 20 causes a sufficient pressure buildup to produce separation of the nut 10C. With the gaps 22A, 22B formed on the opposite sides of the void 20, the explosive charge 34 only needs to produce sufficient pressure to separate the material around the void 20. In some embodiments, the crossover 24 may be rated to generate sufficient explosive energy to set off the explosive charge 34 without the need of a detonator 32. Thus, embodiments may be implemented wherein the nut 10C is equipped with one initiator 28 and one explosive charge 34 in one void 20, and another explosive charge in the other void 20, with a crossover 24 linking the two charges for simultaneous activation upon triggering of the initiator.

Figure 10:
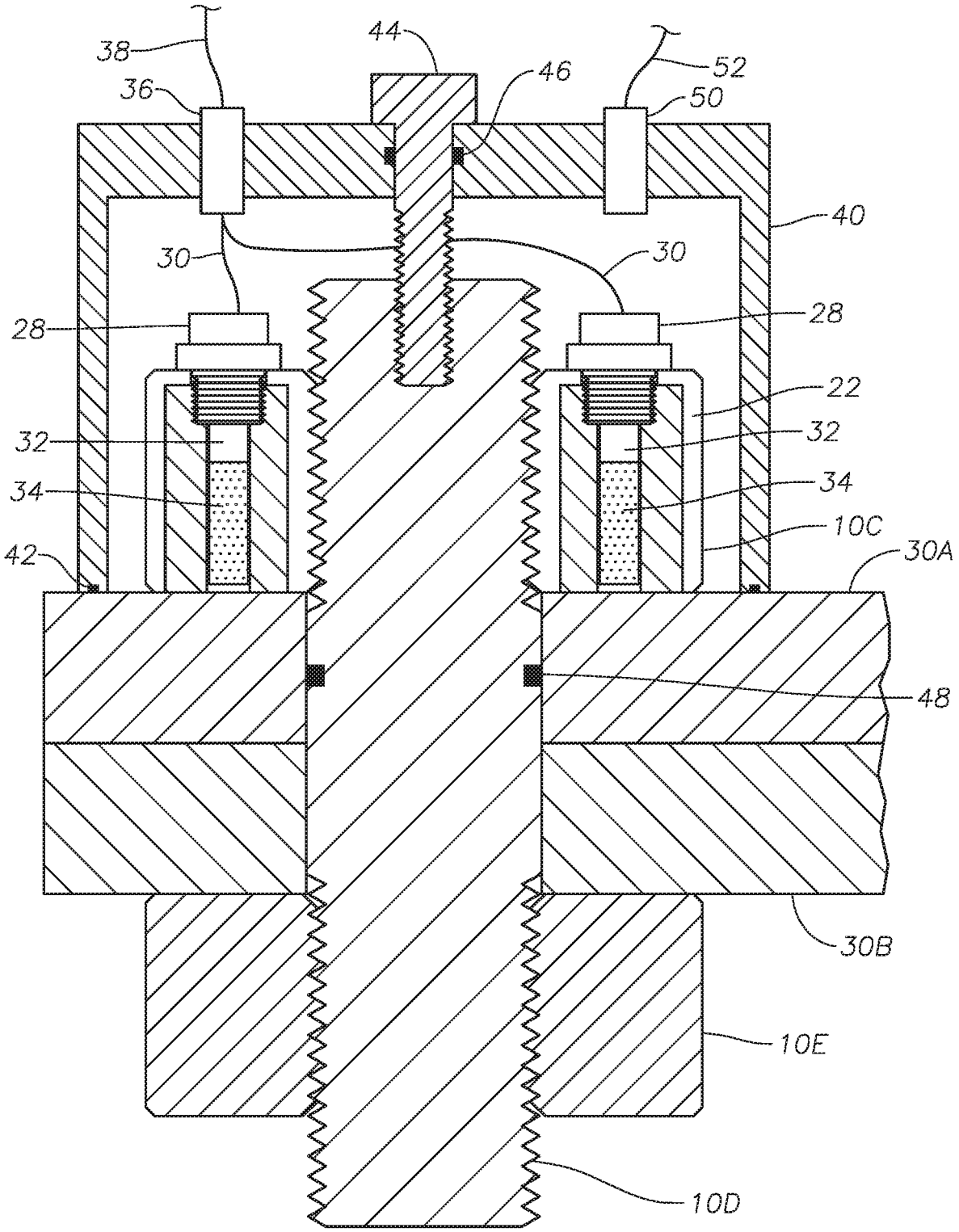
FIG. 10 shows a schematic of a flange junction equipped with an example embodiment of an explosively frangible nut according to the present disclosure.

FIG. 10 shows a cutaway view of another example embodiment of this disclosure. Applications of the explosive fasteners may include environments where the fasteners are exposed to, or directly immersed in, harsh conditions (e.g. underwater). Longevity and reliability of components in such environments requires the protection or isolation of the components. FIG. 10 shows a pair of flanges 30A, 30B coupled and held together via a threaded stud 10D. A conventional nut 10E on the stud 10D retains the lower flange 30B sandwiched against the upper flange 30A. Flange 30A is retained by a frangible nut 10C embodiment as described herein. The frangible nut 10C includes a pair of explosive charges 34 disposed in voids as described herein, detonators 32, and initiators 28 (e.g. FIG. 9). A pressure housing 40 covers the explosively frangible nut 10C. The pressure housing 40 is held in place by a threaded connector 44 engaged with a threaded orifice on an end of the stud 10D. A conventional seal 46 (e.g., annular seal, O-ring) is disposed around the connector 44 to ensure a closed environment within the housing 40. The threaded connector 44 holds the housing 40 in abutment against the surface of the flange 30A. A face seal 42 (e.g. O-ring) at the bottom of the housing 40 walls ensures a closed environment within the housing. The housing 40 may be formed from any suitable material (e.g., metal, plastic, synthetic compound, etc.) depending on the environment or conditions of the particular application.

A conventional pressure rated electrical connector 36 is mounted on the housing 40 to provide an electric current to the initiators 28 via a lead 38 linked to a voltage source (not shown). Each initiator 28 is linked to the connector 36 via an internal electrical lead 30. In some embodiments, a conventional environmental sensor 50 is also disposed on the housing 40 to monitor the internal housing conditions (e.g., pressure, humidity, conductivity, water detector, etc.). A signal from the sensor 50 may be conveyed as desired via a signal lead 52. Embodiments such as disclosed in FIG. 10 provide each explosively frangible nut 10C with its own separate housing and independent electronic triggering functionality. Although the embodiment of FIG. 10 is shown with a stud 10D coupling two flange 30A, 30B connector components, it will be appreciated that the disclosed housing 40 structure may be implemented with other embodiments wherein the explosively frangible nut 10C is used to retain other components as desired. For purposes of this disclosure, use of the term "connector" herein is not to be limited to any specific structure or configuration (e.g., a connector may encompass a profile coupling, a bolted flange, or any other connection known in the art).

Figure 11:
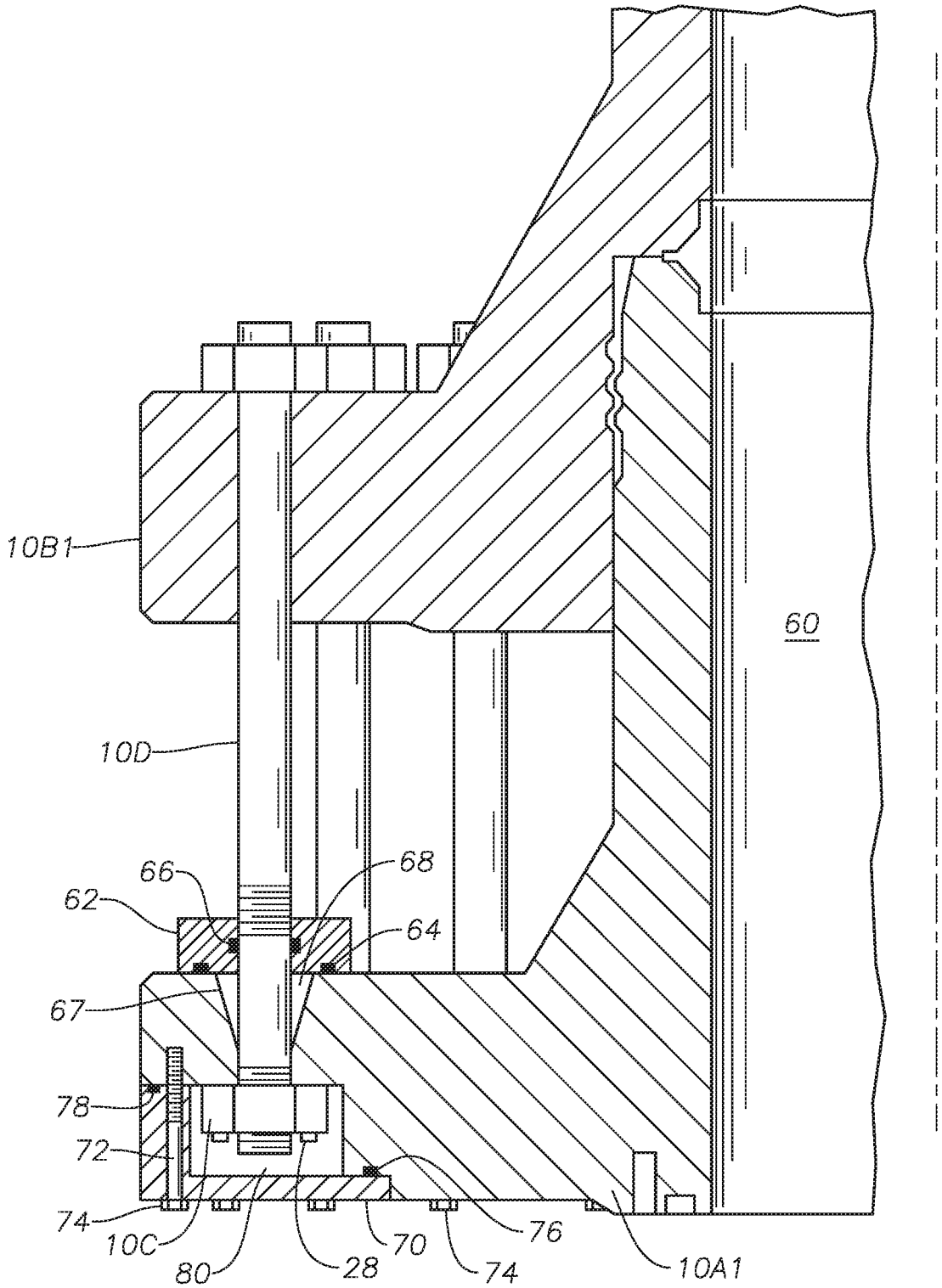
FIG. 11 shows a cross-section of an example embodiment of an explosive quick disconnect system according to the present disclosure.

FIG. 11 shows a cross-section of another example embodiment of this disclosure. Flange 10A1 is configured with an annular through bore 60 and is equipped with an explosively frangible nut 10C as disclosed in the embodiments of FIGS. 7-9. For clarity of illustration, the nut 10C is shown without a pyrotechnic crossover 24 or initiator lead. It will be appreciated that the nut 10C may be implemented in any manner as disclosed herein. The stud 10D coupling flange 10A1 to flange 10B1 is retained on flange 10A1 with the frangible nut 10C securing the end of the stud and another nut 62 sandwiching the flange. The other nut 62 may be configured with a conventional face seal 64 (e.g. O-ring) and a conventional annular seal 66 to provide fluid-tight integrity at the respective stud 10D, nut, and flange 10A1 junctions.

In some embodiments, the stud 10D receptacle 67 on the flange 10A1 is slightly enlarged (shown as a negative cone-shaped space 68 in FIG. 11) on the flange side opposite the frangible nut 10C. If the frangible nut 10C is triggered for separation as described herein, the enlarged receptacle 67 facilitates passage of the stud 10D end through the receptacle, preventing binding, particularly if the stud is stressed at an angle with respect to the flange 10A1. It will be appreciated that embodiments may be implemented with the frangible nuts 10C disposed on the stud 10D ends securing flange 10B1 instead of flange 10A1 (not shown). Such embodiments may be configured with the frangible nuts 10C and other components as disclosed herein.

In some embodiments, a housing 70 is mounted on the flange 10A1 to seal off the frangible nut 10C from the external environment. The housing 70 is affixed to the flange 10A1 with a series of fasteners 72 extending into the flange near the outer periphery of the flange, passing through matching holes in the housing. Conventional fasteners 72 as known in the art may be used to secure the housing 70 to the flange 10A1 (e.g., studs mounted into the flange (pressed friction fit, welded in place, threaded engagement) with nuts 74 affixed on the ends). In some embodiment, the fasteners 72 may be one-piece extended length bolts that are engaged with mating threads formed in the flange 10A1. Face seals 76, 78 (e.g. O-rings) between the housing and flange 10A1 mating surfaces provide fluid-tight integrity for the housing. As shown in FIG. 11, the housing 70 provides an open area 80 around the frangible nut 10C. This open area 80 serves to provide ample room for the initiator 28 leads, crossover 24 links, connector 36 leads, environmental sensor 50 leads, and other components that may be disposed on the flange 10A1 and/or the housing 70 inner surface. In addition, the open area 80 also provides containment for fragments from the separated frangible nuts 10C upon activation. As previously described, embodiments may be implemented with the disclosed frangible nut 10C configurations securing the opposing flange 10B1. In such embodiments, the housing 70 may be configured and affixed to flange 10B1 in a similar manner as described with respect to flange 10A1.

Figure 12:
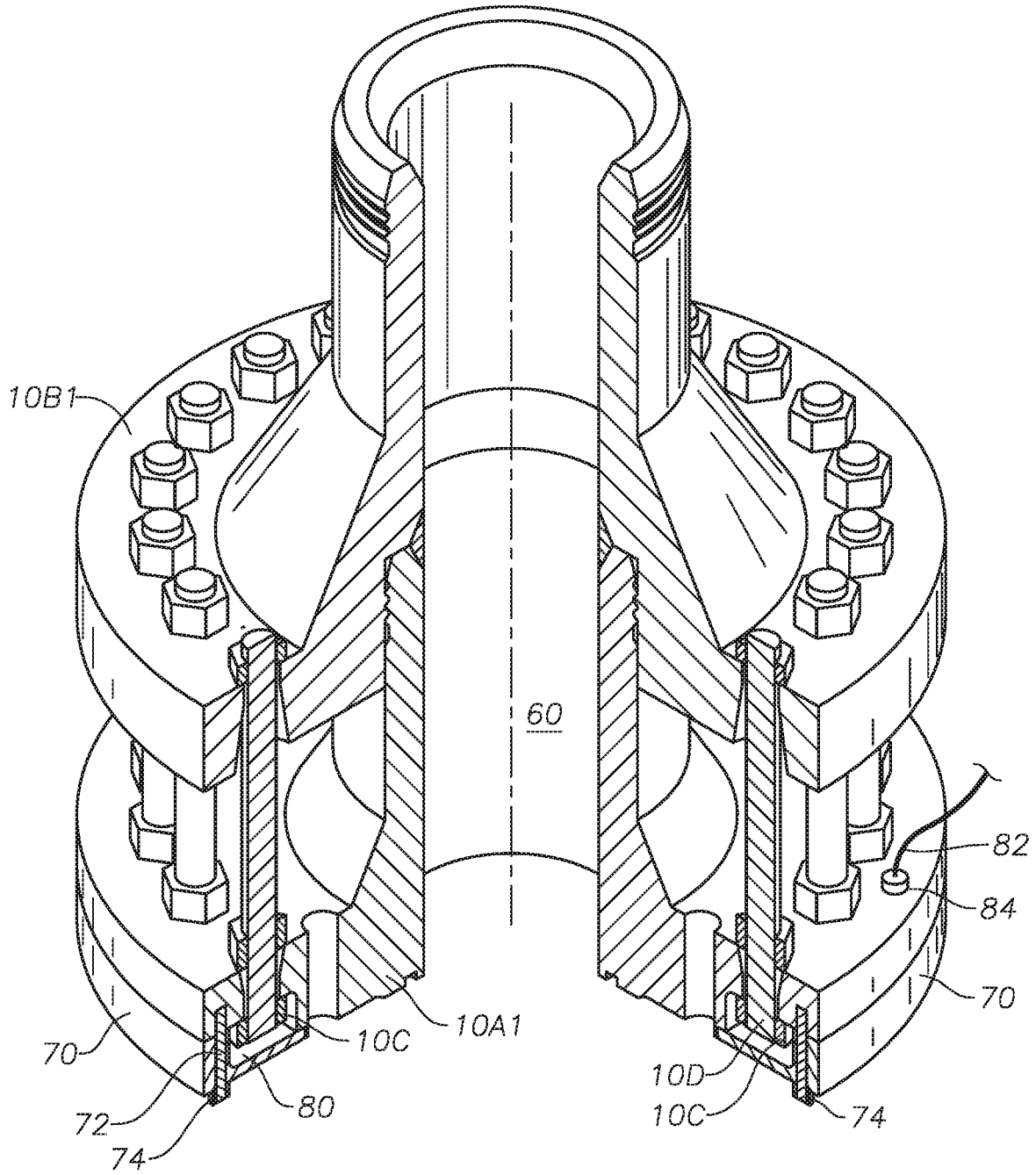
FIG. 12 shows a cut-away perspective of an example embodiment of an explosive quick disconnect system according to the present disclosure.
Figure 13:
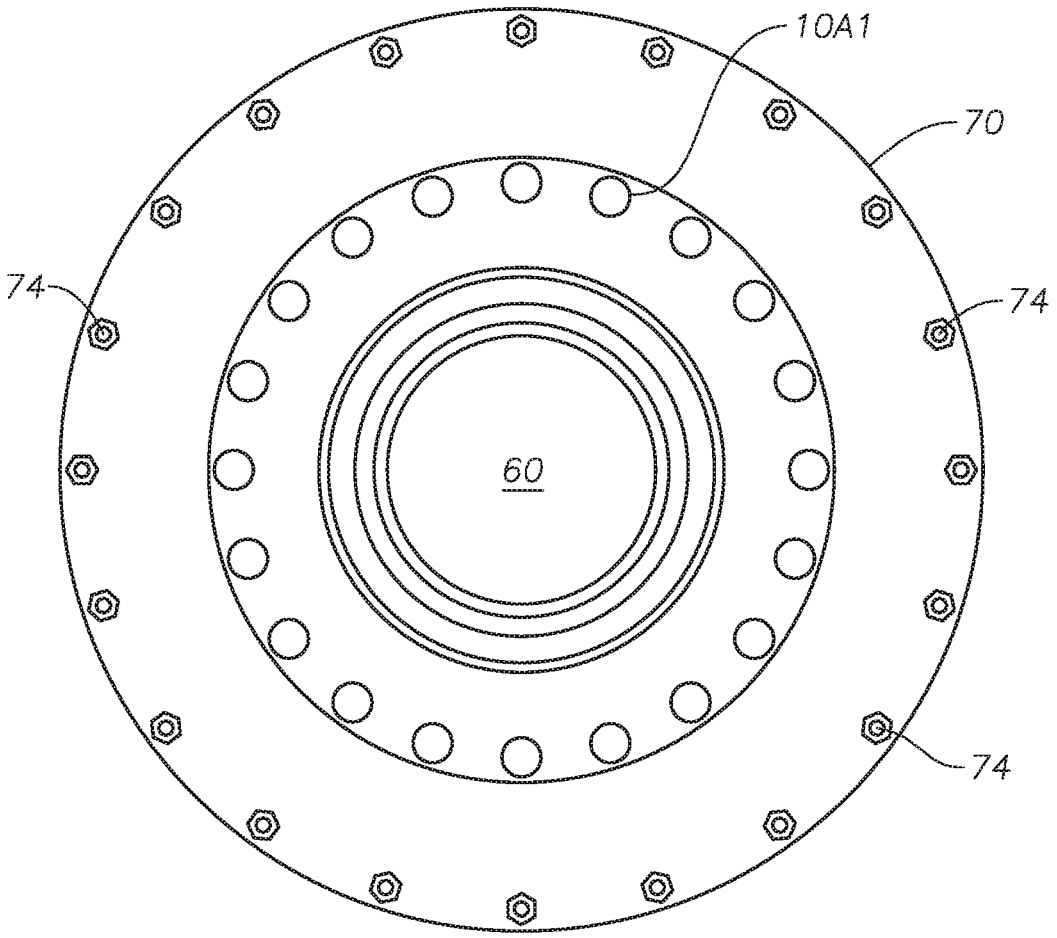
FIG. 13 shows a bottom view of the explosive quick disconnect system of FIG. 12.

FIG. 12 shows a partial cutaway of the flange 10A1 of FIG. 11. As shown in FIG. 12, a housing 70 embodiment is donut-shaped and configured to match the annular profile of the flange 10A1. All of the wiring or leads for the components within the housing 70 are ported via a sheathed conduit 82 exiting the housing via a sealed port 84. FIG. 13 is a plan view of the bottom of the flange 10A1.

Figure 14:
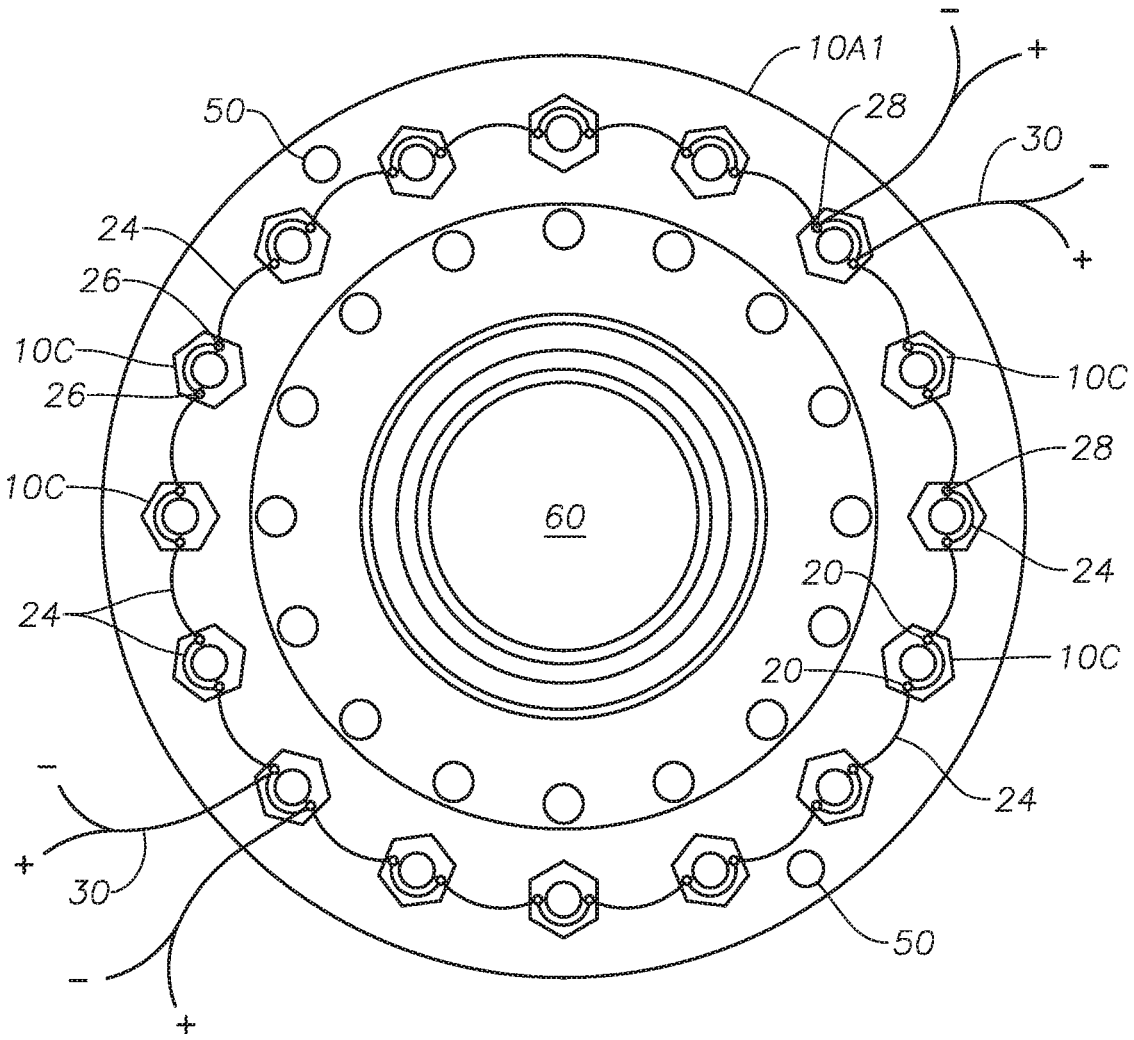
FIG. 14 shows a schematic of an example embodiment of an explosive quick disconnect system according to the present disclosure.

FIG. 14 shows a plan view of another example embodiment of this disclosure. The bottom of a flange 10A1 is shown without a housing 70. This flange 10A1 is configured with multiple frangible nuts 10C securing the studs 10D used to couple the flange to another connector as disclosed herein. The frangible nuts 10C are pyrotechnically linked to one another via a series of interconnected pyrotechnic crossovers 24 coupled to the nuts as disclosed herein. The pyrotechnic crossovers 24 are daisy-chained to provide a conduit between each nut explosive charge (FIG. 9). As previously described, the pyrotechnic crossover 24 conduit contains explosive material that transmits the detonation energy to the explosive charge on each nut 10C without the need for multiple initiators 28 or detonators 32. At least one nut 10C is implemented with a lead 30 coupled to an initiator 28 on the nut to electronically trigger detonation of all the nuts when a current is applied via the lead. Preferably, more than one nut 10C is configured with a lead 30 for activation redundancy. A pair of environmental sensors 50 are also mounted on the flange 10A1 to reside within the housing (70 in FIG. 12).

In light of the embodiments described and illustrated herein, it will be appreciated by those skilled in the art that the example embodiments can be modified in arrangement and detail without departing from the disclosed principles. It will be recognized by those skilled in the art that embodiments of this disclosure may be implemented using conventional materials, hardware, and components as known in the art. Although the foregoing discussion has focused on particular embodiments, any embodiment is freely combinable with any one or more of the other embodiments disclosed herein, and any number of features of different embodiments are combinable with one another, unless indicated otherwise. Accordingly, all such modifications are intended to be included within the scope of this disclosure as defined in the following claims and their equivalents.

What is claimed is:

1. A coupling system, comprising:

a lower marine riser package configured with a connector;

a blowout preventer configured with a connector;

explosively frangible fasteners comprising explosively frangible nuts disposed to couple the lower marine riser package connector to the blowout preventer connector, wherein the explosively frangible nuts are sealed off from the external environment;

each explosively frangible nut having at least one explosive charge disposed thereon; and at least one explosively frangible nut configured for electronic triggering to set off the at least one explosive charge disposed on the nut.

2. The coupling system of claim 1 wherein the explosively frangible nuts are each configured with at least two explosive charges disposed thereon.

3. The coupling system of claim 2 further comprising a pyrotechnic crossover disposed on each explosively frangible nut to link the at least two explosive charges on the nut such that activation of one explosive charge sets off activation of each linked explosive charge.

4. The coupling system of claim 1 wherein the explosively frangible nuts are sealed off from the external environment via a housing configured on one of the lower marine riser package connector and the blowout preventer connector.

5. The coupling system of claim 4 further comprising at least one environmental sensor disposed within the housing.

6. The coupling system of claim 4 wherein the housing is configured to contain fragments from the explosively frangible nuts.

7. The coupling system of claim 4 wherein the housing is configured to house wiring used for the electronic triggering.

8. The coupling system of claim 1 wherein the explosively frangible nuts are pyrotechnically linked together such that activation of one explosive charge on one nut sets off activation of each linked explosive charge on the linked nuts.

9. The coupling system of claim 8 wherein the explosively frangible nuts are pyrotechnically linked together via interlinked pyrotechnic crossovers disposed on the explosively frangible nuts to link the explosive charges disposed thereon.

10. The coupling system of claim 1 wherein the lower marine riser package connector is coupled to the blowout preventer connector via a plurality of studs configured to engage the connectors, with each stud comprising one of the explosively frangible nuts disposed on an end thereof.

11. The coupling system of claim 10 wherein one of the lower marine riser package connector and the blowout preventer connector is configured with a bolt flange to receive the studs engaging the connector, wherein the bolt flange is configured with at least one enlarged stud receptacle to facilitate passage of the stud therethrough.

12. The coupling system of claim 10 wherein the plurality of studs configured to engage the lower marine riser package connector and the blowout preventer connector are configured in a circular pattern surrounding a fluid pass through in the engaged connectors.

13. The coupling system of claim 1 wherein the at least one explosively frangible nut configured for electronic triggering to set off the at least one explosive charge disposed on the nut comprises an initiator to trigger the at least one explosive.

14. The coupling system of claim 1 wherein a plurality of the explosively frangible nuts are each configured for electronic triggering to set off the at least one explosive charge disposed on the nut.

15. A method for separating a lower marine riser package from a blowout preventer, comprising:

electronically triggering the detonation of a plurality of explosively frangible fasteners comprising explosively frangible nuts coupling a connector on the blowout preventer to a connector on the lower marine riser package, wherein the explosively frangible nuts are sealed off from the external environment and each nut has at least one explosive charge disposed thereon; and lifting the lower marine riser package from the blowout preventer.

16. The method of claim 15 wherein the electronically triggering the detonation of the plurality of explosively frangible fasteners comprises igniting at least one pyrotechnic crossover disposed on one of the explosively frangible nuts.

17. The method of claim 15 wherein prior to the electronically triggering the detonation of the plurality of explosively frangible fasteners the lower marine riser package connector is coupled to the blowout preventer connector via a plurality of studs configured to engage the connectors, with each stud comprising one of the explosively frangible nuts disposed on an end thereof.

18. The method of claim 17 wherein one of the lower marine riser package connector and the blowout preventer connector is configured with a bolt flange to receive the studs engaging the connector, wherein the bolt flange is configured with at least one enlarged stud receptacle to facilitate passage of the stud therethrough.

19. The method of claim 15 wherein the electronically triggering the detonation of the plurality of explosively frangible fasteners comprises triggering an initiator coupled to one of the at least one explosive charges disposed on one of the explosively frangible nuts.

20. The method of claim 15 wherein the explosively frangible nuts are sealed off from the external environment via a housing configured on one of the lower marine riser package connector and the blowout preventer connector.

* * * * *